US011828074B1

(12) United States Patent
Espinosa

(10) Patent No.: US 11,828,074 B1
(45) Date of Patent: Nov. 28, 2023

(54) HOLDER FOR SUPPORTING AN ANCHOR ROD AND ANCHOR BODY

(71) Applicant: CETRES HOLDINGS, LLC, Jackson, WY (US)

(72) Inventor: Thomas M. Espinosa, Snohomish, WA (US)

(73) Assignee: CETRES HOLDINGS, LLC, Jackson, WY (US)

( * ) Notice: Subject to any disclaimer, the term of this patent is extended or adjusted under 35 U.S.C. 154(b) by 0 days.

(21) Appl. No.: 16/799,569

(22) Filed: Feb. 24, 2020

Related U.S. Application Data

(62) Division of application No. 15/436,659, filed on Feb. 17, 2017, now Pat. No. 10,577,816.

(60) Provisional application No. 62/297,114, filed on Feb. 18, 2016.

(51) Int. Cl.
*E04G 17/04* (2006.01)
*E04B 1/41* (2006.01)

(52) U.S. Cl.
CPC ..... *E04G 17/04* (2013.01); *E04B 1/4157* (2013.01)

(58) Field of Classification Search
CPC .... E04B 1/4121; E04B 1/4171; E04B 1/4128; E04B 1/4157; E04B 1/40; E04B 1/4135; E04B 1/4114; E04G 21/185; E04G 21/167; E04G 21/142; E04G 17/04; B28B 23/0056; B28B 23/005; F16B 13/066
See application file for complete search history.

(56) References Cited

U.S. PATENT DOCUMENTS

| | | | | |
|---|---|---|---|---|
| 1,088,290 | A | 2/1914 | McAllister | |
| 1,218,378 | A | 3/1917 | Dippel | |
| 3,585,771 | A * | 6/1971 | Pinniger | E04B 1/215 52/251 |
| 4,000,591 | A * | 1/1977 | Courtois | B28B 23/005 52/689 |
| 4,007,564 | A | 2/1977 | Chisholm | |
| 4,437,642 | A * | 3/1984 | Holt | B66C 1/66 249/175 |
| 6,089,522 | A | 7/2000 | Haslem | |
| 6,119,413 | A * | 9/2000 | Shaw | E04H 9/02 52/167.1 |
| 6,195,949 | B1 * | 3/2001 | Schuyler | E04H 9/14 52/223.13 |
| 6,341,452 | B1 | 1/2002 | Bollinhaus | |
| 8,621,816 | B1 | 1/2014 | Lin | |
| 8,943,777 | B2 | 2/2015 | Espinosa | |
| 9,222,251 | B2 | 12/2015 | Espinosa | |
| 9,255,409 | B2 | 2/2016 | Moore | |
| 9,410,340 | B2 * | 8/2016 | Zhao | F03D 13/22 |
| 9,702,139 | B2 | 7/2017 | Espinosa | |
| 10,047,516 | B2 * | 8/2018 | Espinosa | E04B 1/4121 |

(Continued)

FOREIGN PATENT DOCUMENTS

WO WO 2014185911 A1 11/2014

*Primary Examiner* — Rodney Mintz
(74) *Attorney, Agent, or Firm* — FRESH IP PLC

(57) ABSTRACT

A holder for supporting a threaded rod for being embedded in concrete, comprising a central portion including a first opening for receiving an end portion of a threaded rod; a ring portion; arm portions connecting the central portion to the ring portion, the arm portions including respective base portions; leg portions attached to the ring portion; and the central portion extending above and below the base portions.

16 Claims, 15 Drawing Sheets

(56) References Cited

U.S. PATENT DOCUMENTS

| | | | | |
|---|---|---|---|---|
| 10,047,517 | B2 * | 8/2018 | Espinosa | E04B 1/4171 |
| 10,577,816 | B1 * | 3/2020 | Espinosa | E04G 21/185 |
| 2011/0041449 | A1 | 2/2011 | Espinosa | |
| 2011/0173916 | A1 * | 7/2011 | Knapp | E04F 15/04 52/650.3 |
| 2013/0067849 | A1 | 3/2013 | Espinosa | |
| 2013/0207305 | A1 | 8/2013 | Moore | |
| 2014/0157717 | A1 | 6/2014 | Espinosa | |
| 2015/0204101 | A1 * | 7/2015 | Zhao | F03D 13/22 52/704 |
| 2016/0069065 | A1 | 3/2016 | Espinosa | |
| 2016/0069066 | A1 * | 3/2016 | Connell | F16B 5/0225 52/701 |
| 2016/0251846 | A1 | 9/2016 | Kanno | |
| 2016/0326745 | A1 * | 11/2016 | Lechuga | E04C 2/52 |
| 2017/0218618 | A1 * | 8/2017 | Emerson | E04B 1/003 |
| 2017/0234004 | A1 * | 8/2017 | Pilz | E04B 2/7457 52/232 |
| 2017/0241129 | A1 | 8/2017 | Mahrenholtz | |
| 2017/0321434 | A1 | 11/2017 | Shadwell | |
| 2017/0342705 | A1 | 11/2017 | Espinosa | |
| 2017/0342706 | A1 | 11/2017 | Espinosa | |
| 2018/0010627 | A1 | 1/2018 | Shadwell | |
| 2018/0030736 | A1 * | 2/2018 | Chen | F16B 7/0453 |

* cited by examiner

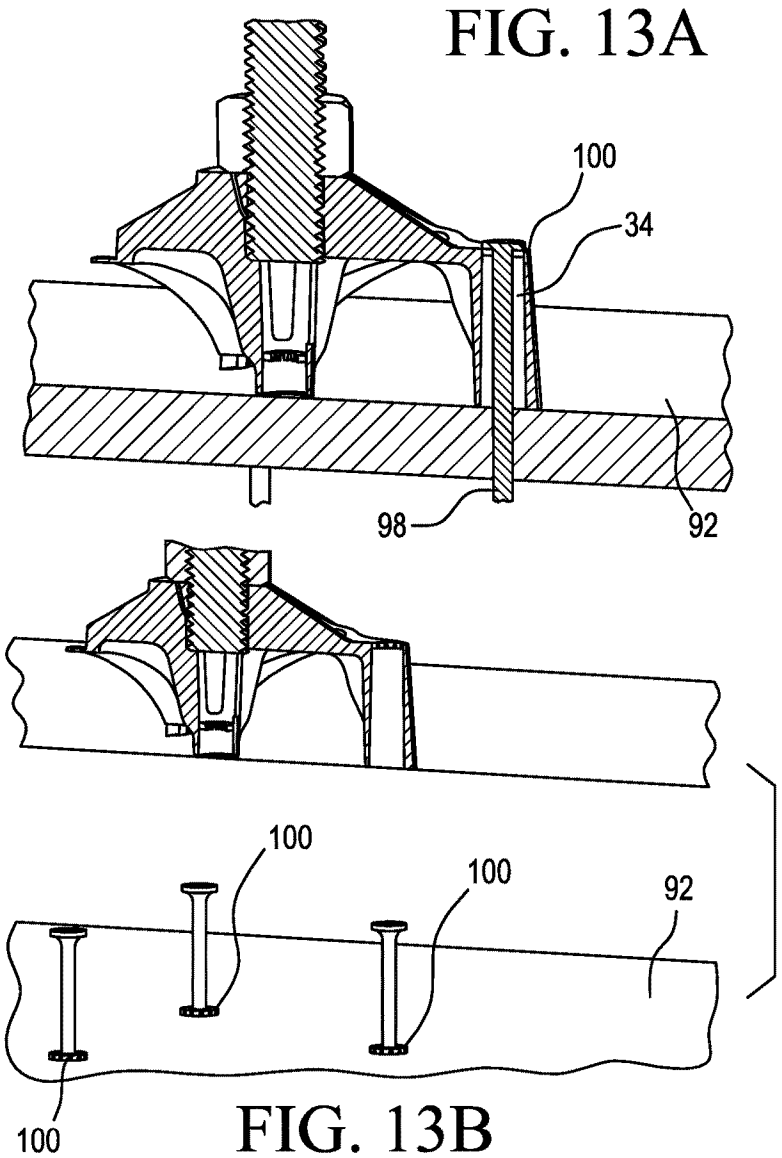
FIG. 13A
FIG. 13B
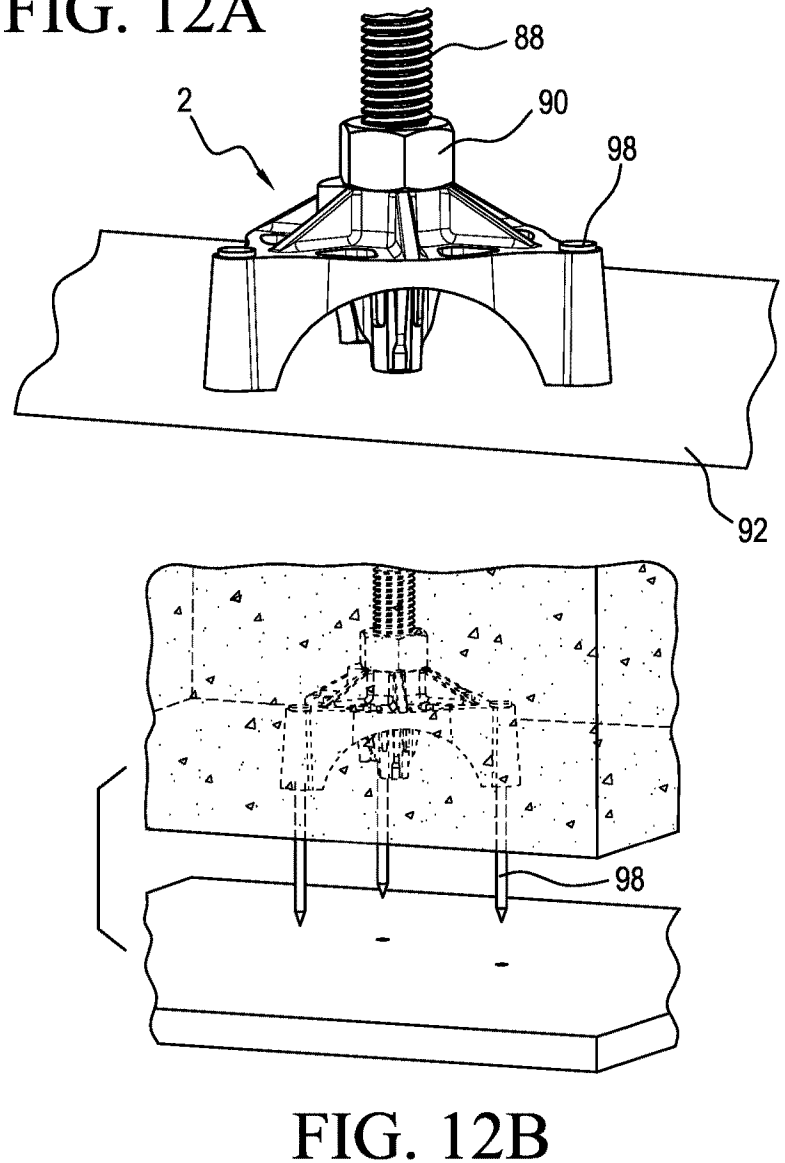
FIG. 12A
FIG. 12B

HOLDER FOR SUPPORTING AN ANCHOR ROD AND ANCHOR BODY

RELATED APPLICATIONS

This is a divisional application of application Ser. No. 15/436,659, filed Feb. 17, 2017, which claims priority of provisional application Ser. No. 62/297,114, filed Feb. 18, 2016, both of which are hereby incorporated by reference.

FIELD OF THE INVENTION

The present invention is generally directed to holders for supporting anchor rods and anchor bodies.

SUMMARY OF THE INVENTION

The present invention provides a holder for supporting a threaded rod for being embedded in concrete, comprising a central portion including a first opening for receiving an end portion of a threaded rod; a ring portion; arm portions connecting the central portion to the ring portion, the arm portions including respective base portions; leg portions attached to the ring portion; and the central portion extending above and below the base portions.

The present invention also provides a holder for supporting a threaded rod for being embedded in concrete, comprising a base portion; a central portion extending upwardly from the base portion, the central portion including an opening for receiving an end portion of a threaded rod; arm portions extending radially from the base portion; leg portions attached to respective ends of the leg portion; and foot portions attached to respective bottom ends of the leg portions.

BRIEF DESCRIPTION OF THE DRAWINGS

FIG. 12A is perspective view of the holder of FIG. 2 supporting a threaded rod and a nut used as an anchor body, with the holder attached to a form board with nails through outlying openings.

FIG. 12B shows the form board removed from the concrete, with the nails still attached to the holder.

FIG. 13A is a perspective cross-sectional view of FIG. 12A embedded in concrete, showing the heads of the nails being supported by a weakened flange.

FIG. 13B shows the holder embedded in concrete and the form board removed from the holder with the nails still attached to the form board.

DETAILED DESCRIPTION OF THE INVENTION

Figure 1:
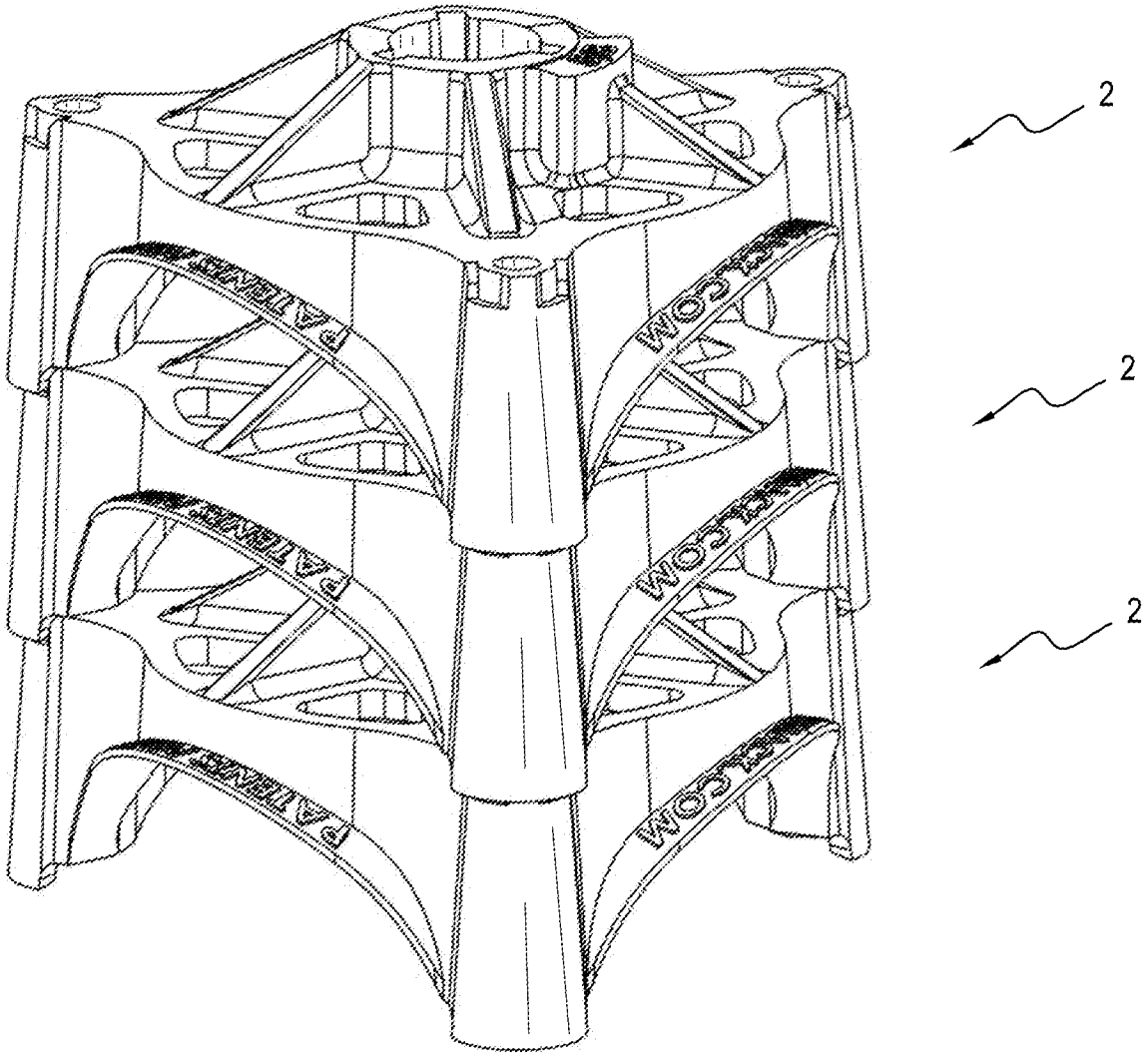
FIG. 1 is a perspective view of three stacked holders embodying the present invention.

The present invention is related to U.S. Pat. Nos. 8,943,777 and 9,222,251, hereby incorporated by reference. Referring to FIG. 1, a plurality of holders 2 advantageously stacked on top of one another for compactness for shipping or storage is disclosed. Although three holders are shown, it should be understood that stacking is not limited to this number.

Figure 2:
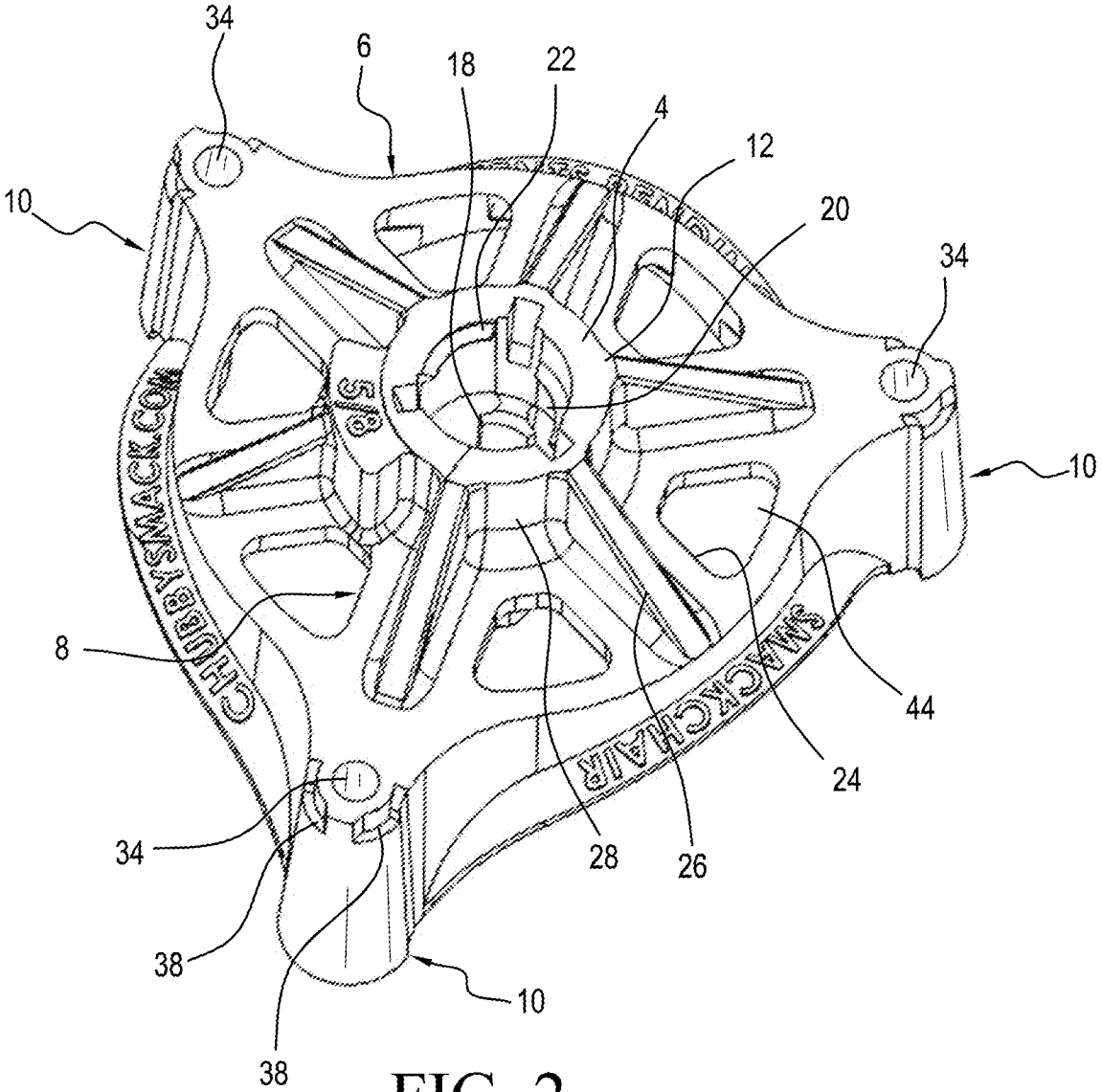
FIG. 2 a top perspective views of one of the holders shown in FIG. 1.
Figure 3:
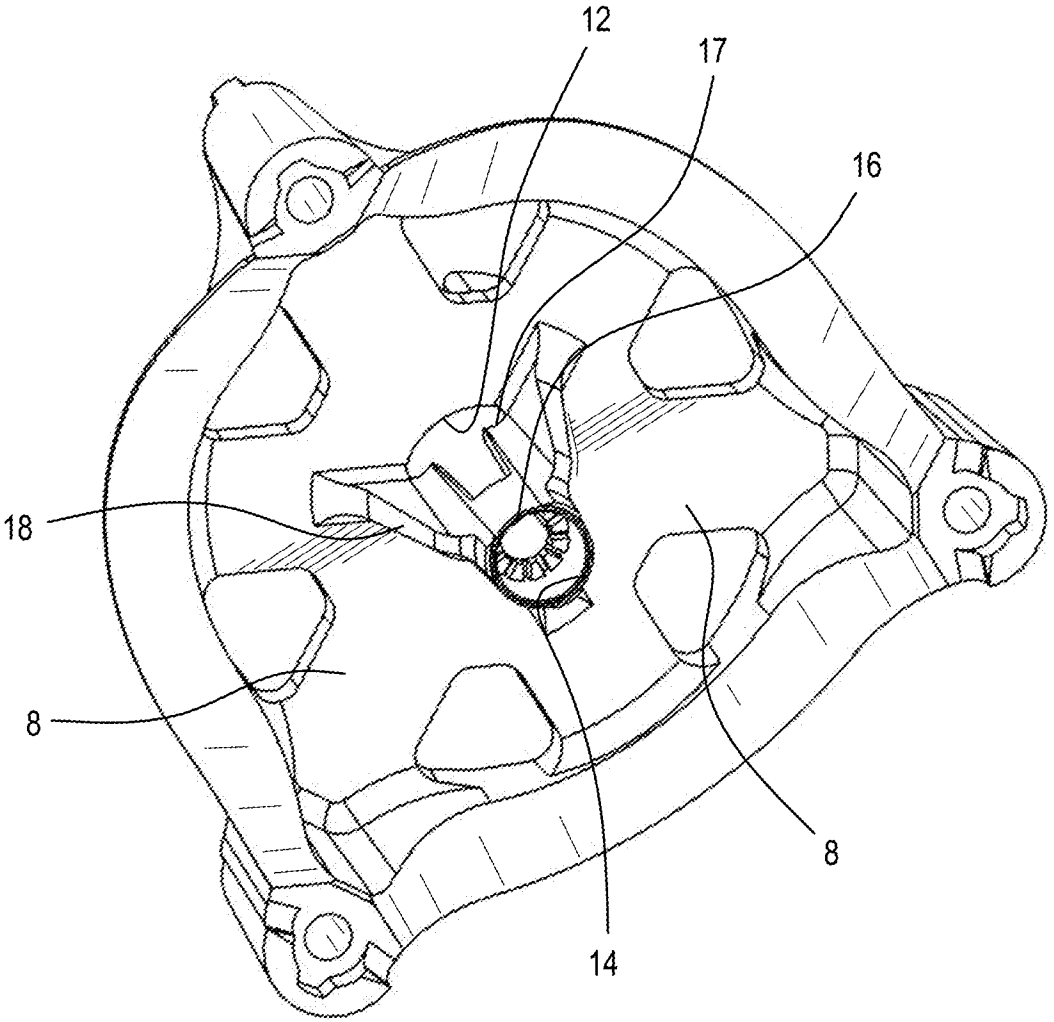
FIG. 3 is bottom perspective view of the holder shown in FIG. 2.
Figure 4:
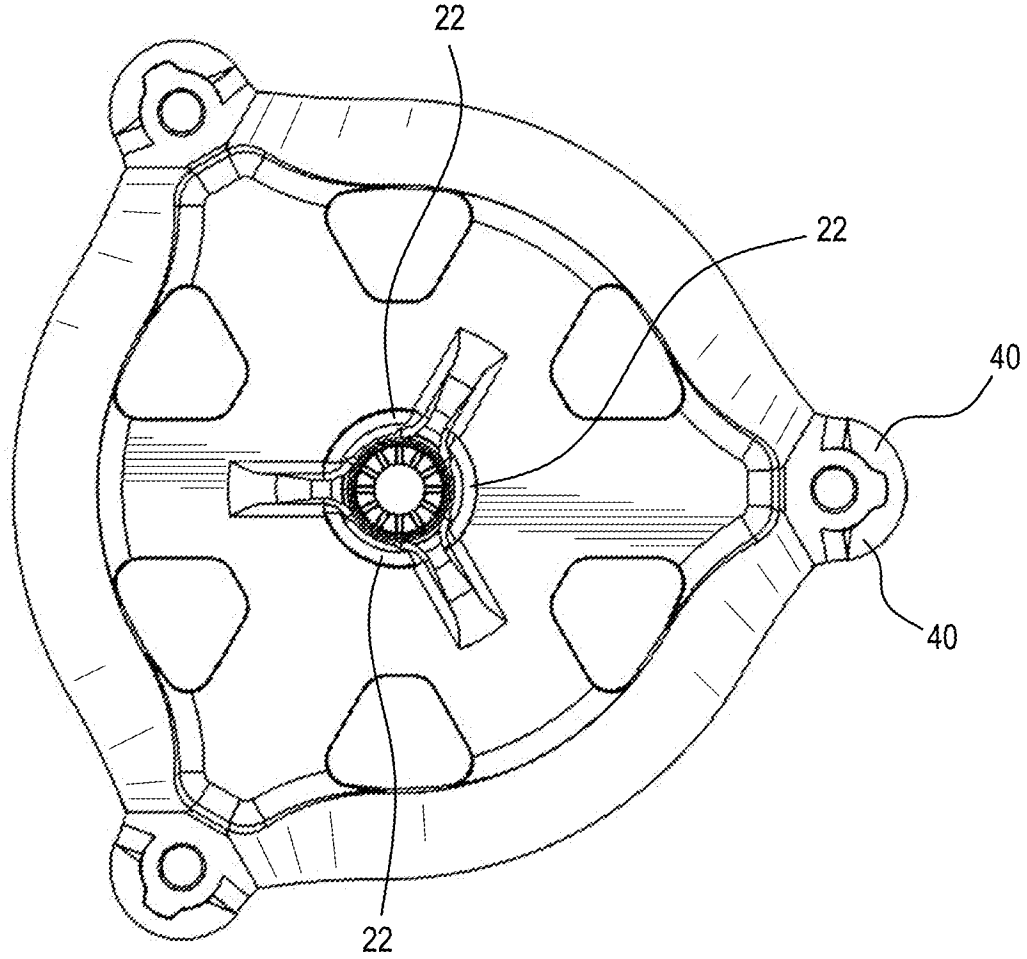
FIG. 4 is a bottom plan view of the holder shown in FIG. 2.

Referring to FIG. 2, the holder 2 includes a central portion 4, a ring portion 6, arm portions 8 connecting the central portion 4 to the ring portion 6 and leg portions 10 attached to the ring portion 6. The central portion 4 includes an opening 12 for receiving the bottom end portion of a threaded rod, such as an anchor rod used in holdown systems as disclosed, for example, in U.S. Pat. No. 8,943,777. Another opening 14 is disposed coaxially and below the opening 12. The opening 12 has a diameter to accommodate the diameter of the threaded rod. The opening 14 has a diameter to accommodate the diameter of the head of a screw or nail. The opening 14 is provided by a sleeve portion 16 with a slotted upper portion 17 attached to the arm portions 8 with member portions 18. Top edges of the slotted portion 17 are within the opening 12 to define the bottom extent of the opening 12 and provide a stop to the bottom end of the threaded rod. The bottom end of the sleeve portion 16 is preferably at the same level as the bottom end of the leg portions 10. The leg portions 10 are preferably arranged around the ring portion 6 at 120° apart. The arm portions 8 are preferably directed toward the center of the opening 14, which is co-axial with the opening 12.

The opening 12 has a cylindrical surface 20 from which segmented thread portions 22 that together make up one revolution project. The thread portions 22 advantageously facilitate the threading of the threaded rod into the opening 12. The top edges of the slotted portion 17 advantageously provide a stop to the bottom end of the tie rod to keep the bottom end a distance from the form board.

Each of the arm portions 8 includes a base portion 24 and a rib portion 26, preferably triangular in shape, disposed transversely to the base portion 24. The wall 28 of the opening 12 preferably extends upwardly from the base portion 24. The height portion of the rib portions 26 are attached to the wall 28 to provide rigidity to the wall 28.

A circumferential flange 31 is disposed inside the opening 14. The circumferential flange 31 provides a smaller opening 30 inside the opening 14. The circumferential flange 31 is weakened so as to be readily breakable. Preferably, a plurality of radial grooves 35 cut partway into the thickness of the flange 31 are made to weaken the flange 31. The grooves 35 define a plurality of wedge-shaped members 32 extending into the opening 14. The wedge-shaped members 32 remain attached to a thin wall 33 forming the top of the flange. Preferably, the outer radial ends of the wedge-shaped members 32 may also be separated from the wall of the opening 14 so that wedge-shaped members 32 are only attached to the thin wall 33. The opening is sized for the diameter of the shank portion of a screw or nail. The flange 31 advantageously supports the head of the screw or nail to secure the holder to the form board but allows to be broken through when the form board is removed after the concrete is cured. Weakening the circumferential flange 31 allows the screws or nails to stay attached to the form board during removal, saving time in the removal of the screws or nails from the holders 2 after the concrete has cured.

The leg portions 10 each includes a vertical opening 34 for receiving a screw or nail for attaching the holder 2 to the form board. The opening 34 may include a narrowed portion 36 (see FIG. 11A) to hold the screw or nail inside the opening 34. The top end of the leg portions 10 includes shoulders 38 that receive corresponding projection 40 at the bottom of each leg portion 10. The mating of the shoulders 38 with projections 40 provide for stacking the holders 2, as shown in FIG. 1.

Referring back to FIG. 2, the opening 12 includes ramped grooves 42 that receive the member portions 18 when the holders are stacked together. Openings 44 between the arm portions 8 advantageously allow any air bubbles from underneath the holder 2 to escape.

Figure 6:
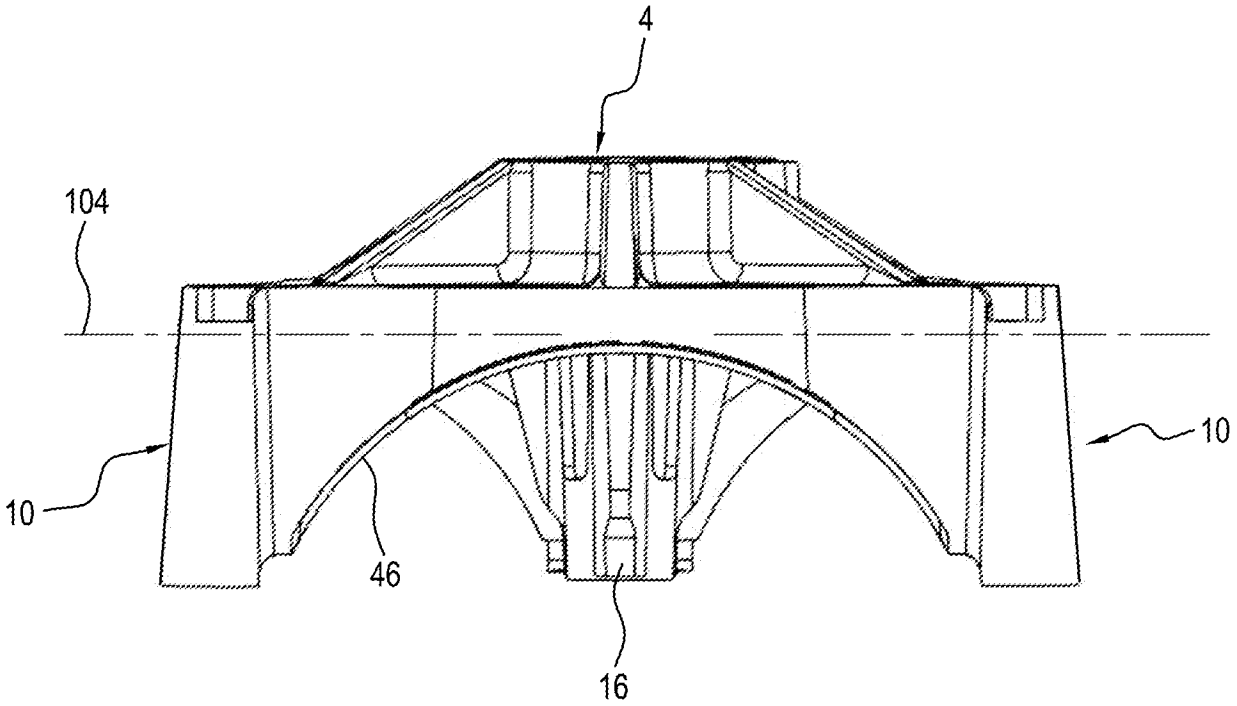
FIG. 6 is a side elevational view of the holder shown in FIG. 2.

Referring to FIG. 6, arched openings 46 are provided between the leg portions 10. The openings 46 advantageously allow the concrete being poured to flow into and underneath the holder 2. The openings 44 advantageously allow the escape of air bubbles from underneath the holder 2. By having three leg portions 10, the openings 46 between the leg portions 10 can be made larger than if there were more leg portions. A larger opening advantageously facilitates the flow of concrete into the underneath area of the holder 2.

Figure 7:
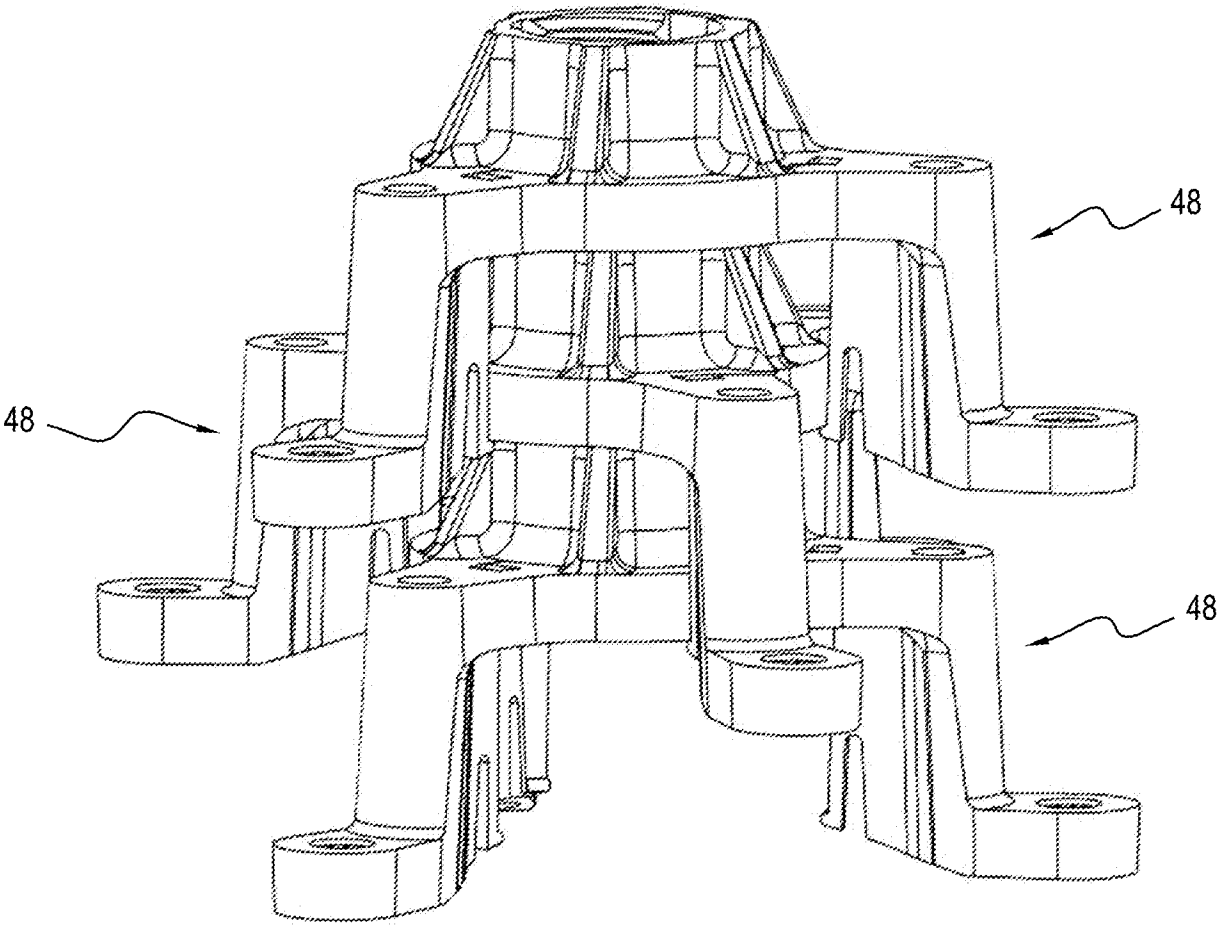
FIG. 7 is a side perspective view of three stacked holders showing another embodiment of a holder embodying the present invention.

Referring to FIG. 7, a stack of another embodiment of holders 48 is disclosed. As with the holders 2, the holders 48 are advantageously stackable to provide a compact volume for storage or shipping.

Figure 8:
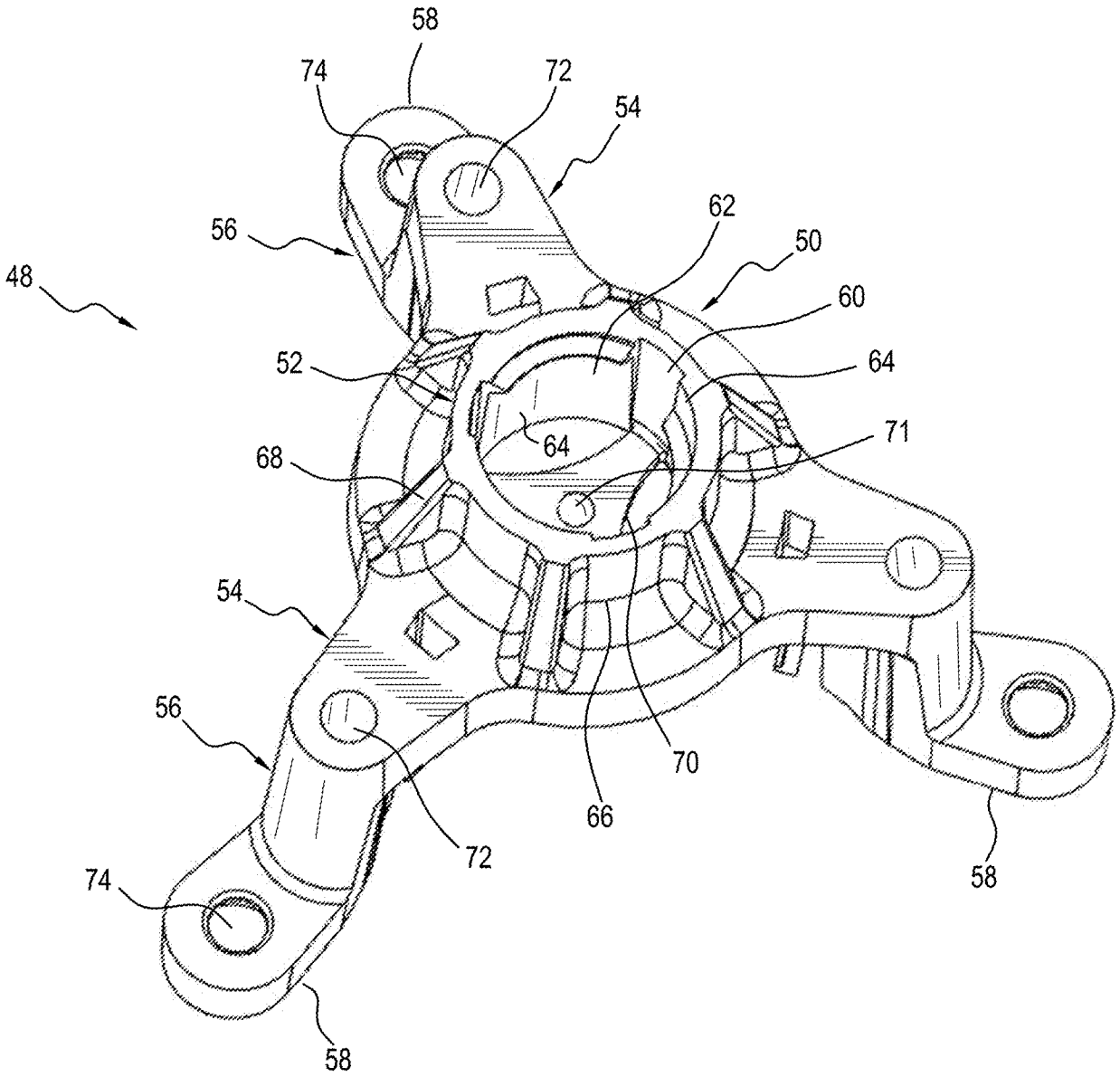
FIG. 8 is a top perspective view of the holder shown in FIG. 7.
Figure 9:
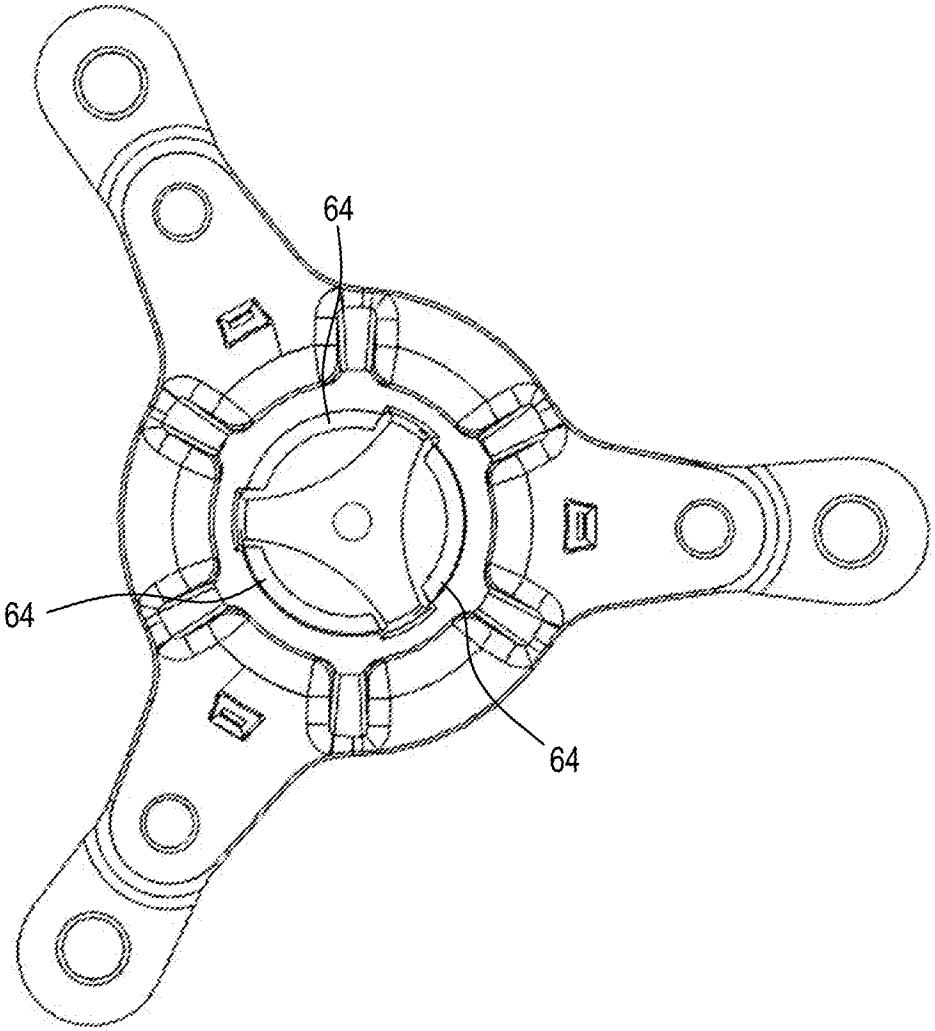
FIG. 9 is top plan view of the holder shown in FIG. 8.

Referring to FIGS. 8 and 9, each of the holders 48 includes a base portion 50, a central portion 52 extending from the base portion 50, arm portions 54 extending outwardly from the base portion 50, leg portions 56 extending downwardly from the outer ends of the arm portions 54, and foot portions 58 extending outwardly from the bottom ends of the leg portions 56. The base portion 50 is preferably circular in plan view. The arm portions 54 are preferably arranged 120° apart around the base portion 50. The central portion 52 includes an opening 60 with a cylindrical inside surface 62 for supporting an end portion of a threaded rod. Segmented thread portions 64 that together make up one revolution project from the cylindrical surface 62. The thread portions 64 advantageously facilitate the threading of the threaded rod into the opening 60. The central portion 52 has a tubular wall 66 supported by rib portions 68. A stop member portion 70 extends across the bottom of the opening 60 to advantageously stop the bottom end of the threaded rod from progressing any further toward the form board. A projection 71 disposed on the stop member 70 marks the center of the opening 60 to aid in aligning the holder 48 on the form board. The arm portions 54 are preferably directed diametrically toward the projection 71 to further aid in aligning the holder on the form board. The stop member portion 70 advantageously assures the preferred positioning of the bottom end of the threaded rod inside the concrete. The stop member portion 70 is preferably triangular in plan view to provide openings between itself and the cylindrical surface 62. Vertical holes 72 are provided through the leg portions 56 for receiving screws or nails in attaching the holder 48 to the form board. The foot portions 58 also have holes 74 as an alternative or in addition to the holes 72 for the same purpose of attaching the holder 48 to the form board with screws or nails.

Figure 10:
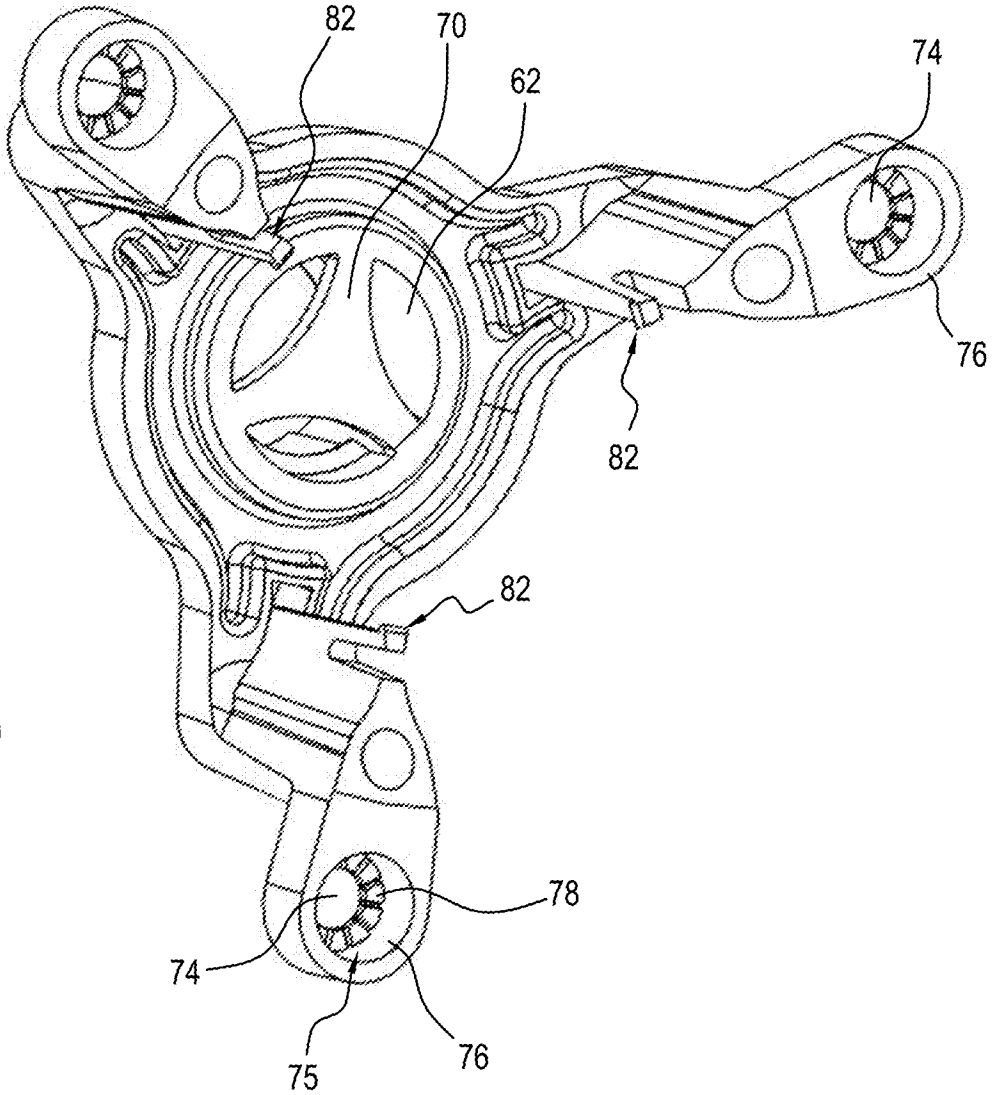
FIG. 10 is a bottom perspective view of the holder shown in FIG. 8.

Referring to FIG. 10, the holes 74 are preferably weakened to allow the head of the screw or nail to pass through the larger holes 76 underneath. The hole 74 is defined by a circumferential flange 75 disposed in the hole 76. The circumferential flange 75 is weakened so as to be readily breakable to allow the head of the nail or screw to break through. The circumferential flange 75 has the same structure as the circumferential flange 31 wherein a plurality of radial grooves are cut partway into the thickness of the flange 75. The grooves define a plurality of wedge-shaped members 78 extending into the hole 76. The wedge-shaped members 78 remain attached to a thin wall 80 forming the top of the flange. Preferably, the outer radial ends of the wedge-shaped members 78 may also be separated from the wall of the opening 76 so that wedge-shaped members 78 are only attached to the thin wall 80. The hole 74 is sized for the diameter of the shank portion of a screw or nail. The flange 75 advantageously supports the head of the screw or nail to secure the holder to the form board but allows to be broken through when the form board is removed after the concrete is cured. Weakening the circumferential flange 75 allows the screws or nails to stay attached to the form board during removal, saving time in the removal of the screws or nails from the holders 48 after the concrete has cured. The wedge-shaped members 78 are preferably attached only to the ring member 80. Finger portions 82 are used to hook to the underside of the base portion 50 of the holder 48 below when stacked together (see FIG. 7). The finger portions 82 have sufficient spring action to hook onto and unhook from the holder below.

Figure 11A:
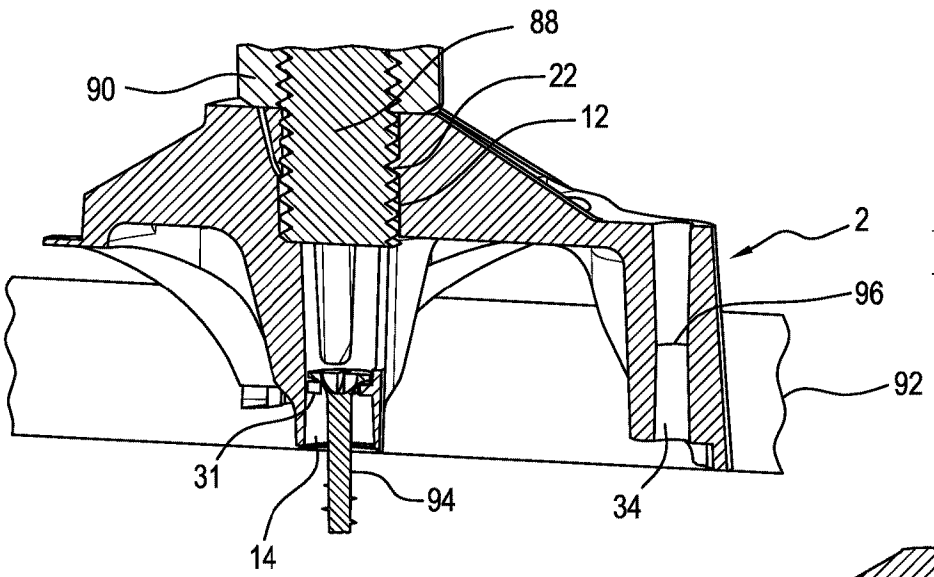
FIG. 11A is a perspective of the holder of FIG. 2, showing a threaded rod attached to the holder and a nut used as an anchor body, with the holder attached to a form board through a central opening with a weakened flange to hold the head of the screw.

Referring to FIG. 11A, the holder 2 is shown with an anchor rod 88 threaded to the thread portion 22 in the opening 12. A nut 90 locks the anchor rod 88 in place. The nut 90 advantageously serves as an anchor body that creates a shear cone to resist a load on the anchor rod. The holder 2 is attached to a form board 92 with a screw 94 or nail received in the opening 30 of the circumferential flange 31. The larger opening 14 is sized to allow the head of the screw 94 to pass through when the form board is removed. The opening 34 may have a narrowed intermediate portion 96 with a diameter smaller than the diameter of the shank of the screw or nail so as to hold the screw or nail in the opening 34 prior to the holder's attachment to the form board.

Figure 11B:
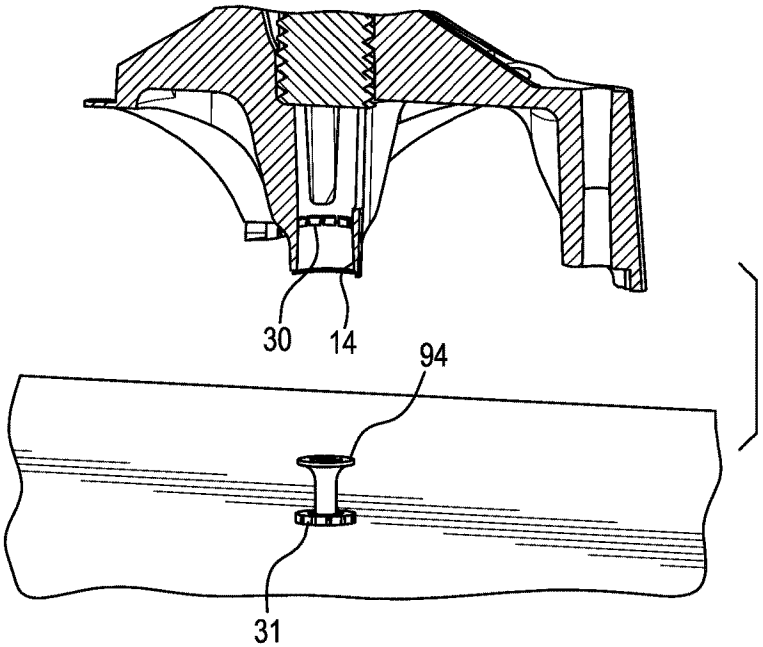
FIG. 11B shows the holder of FIG. 11A embedded in concrete with the screw remaining with the form board when the form board is removed from the concrete.

Referring to FIG. 11B, the form board 92 has been separated from the cured concrete, taking the screw 94 or nail with it. The screw head breaks through the weakened flange 31. Some of the wedge-shaped members 32 may remain behind still attached to the wall of the opening 14 or may be carried by the screw 94 or nail after the screw or nail breaks through the opening.

Referring to FIGS. 12A and 12B, the holder 2 is shown attached to the form board 92 with nails 98 through the openings 34. The nails 98 remain with the holder 2 after the form board 92 is removed from the concrete. The nails are then pulled out.

Referring to FIGS. 13A and 13B, the openings 34 are enlarged to accommodate the size of the heads of the nails or screws. A circumferential flange 100 is provided at the top of the opening 34 to provide temporary support for the head of the screw or nail. The circumferential flange 100 is weakened in the same manner as the flange 31 so as to be readily breakable. Partially cutting into the thickness of the circumferential flange 100 at the juncture with the wall of the opening 34 may also be used to weaken and make flange breakable. The nails 98 are shown still attached to the form board 92 after the form board is removed from the concrete, the nail heads breaking through the circumferential flange 100. Pieces of the circumferential flange 100 may be carried by the nails or remain on the holder.

Figure 14B:
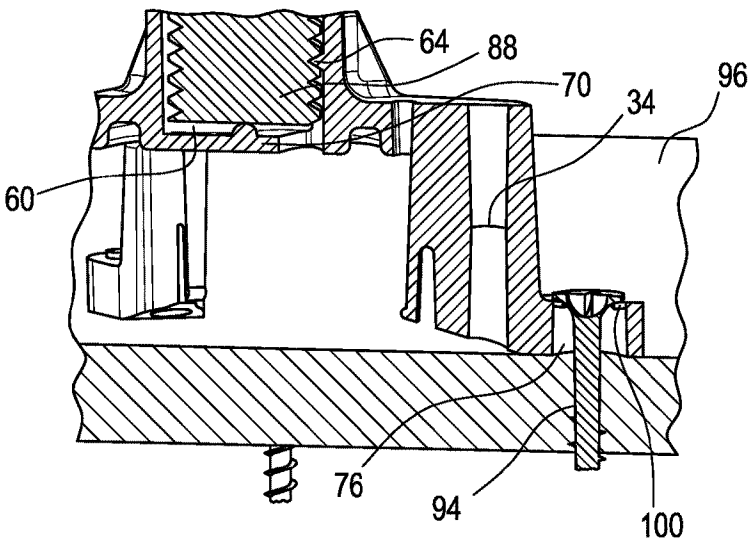
FIG. 14B is a perspective cross-sectional of FIG. 14A, showing a weakened flange supporting the head of a screw.
Figure 14A:
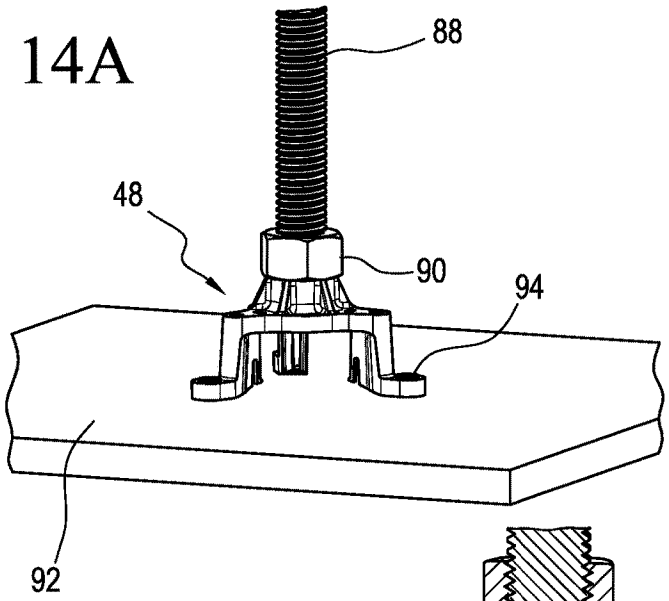
FIG. 14A is a perspective view of the holder of FIG. 8 supporting a threaded rod and a nut as an anchor body, the holder being attached to a form board.
Figure 14C:
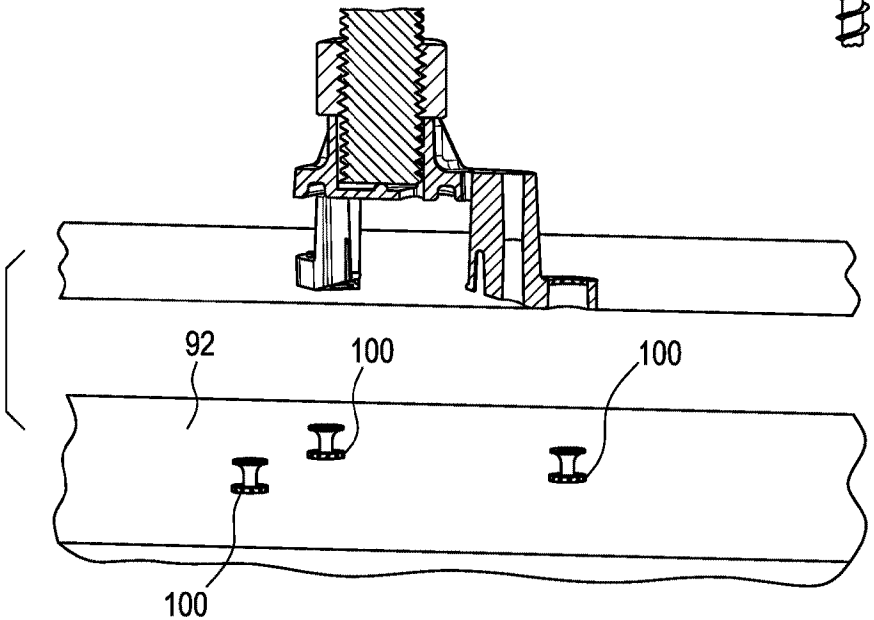
FIG. 14C shows the holder of FIG. 14A embedded in concrete and the form board removed from the concrete with the screws still attached to the form board.

Referring to FIGS. 14A, 14B and 14C, the holder 48 is shown attached to the form board 92 with screws 94 through the holes 74. The circumferential flange 100 is made to break to allow the heads of the screws 94 to pass through the holes. The screws 94 remain attached to the form board 92 when the form board is removed from the cured concrete, advantageously saving the extra step of removing the screws from the holder if the holes 76 were not configured to allow the heads of the screws to pass through.

Figure 5:
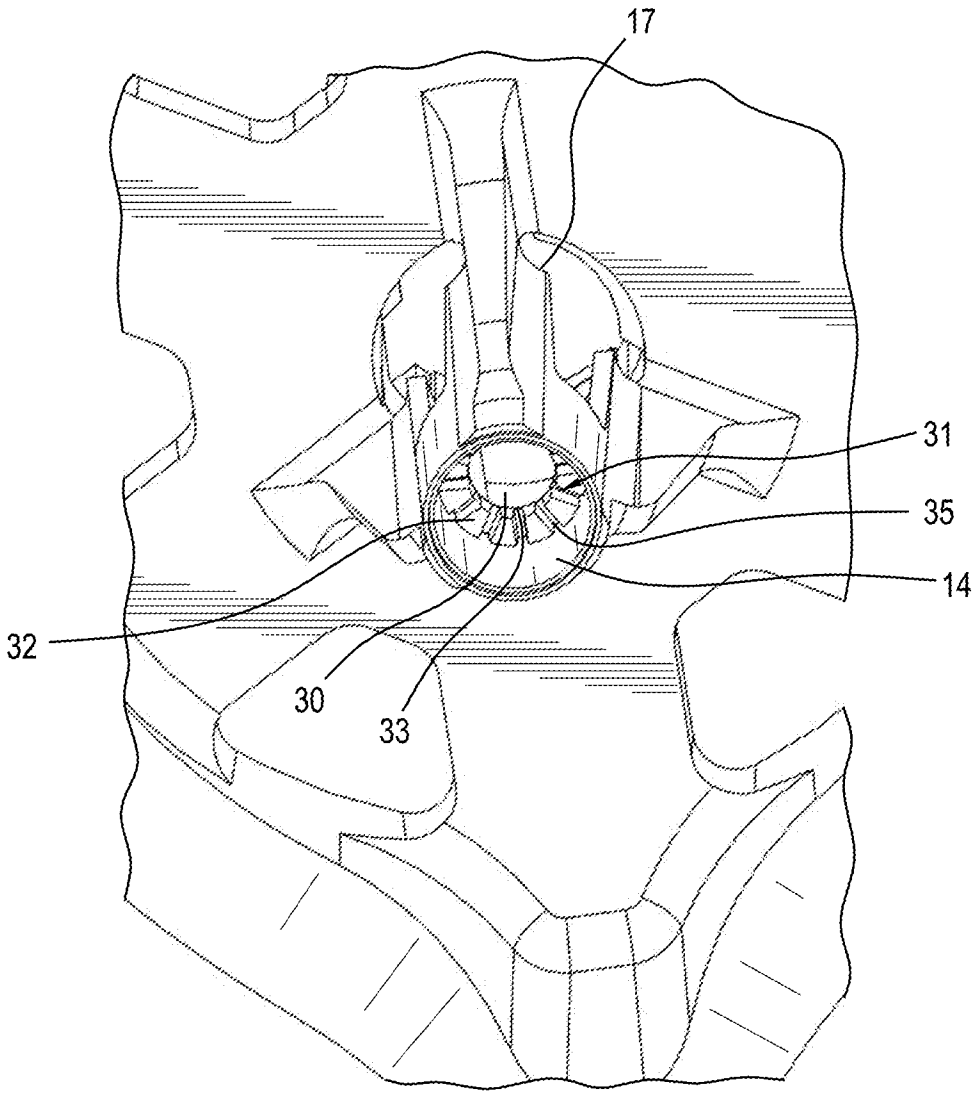
FIG. 5 is an enlarged bottom perspective view of a portion of the holder shown in FIG. 2.
Figure 15B:
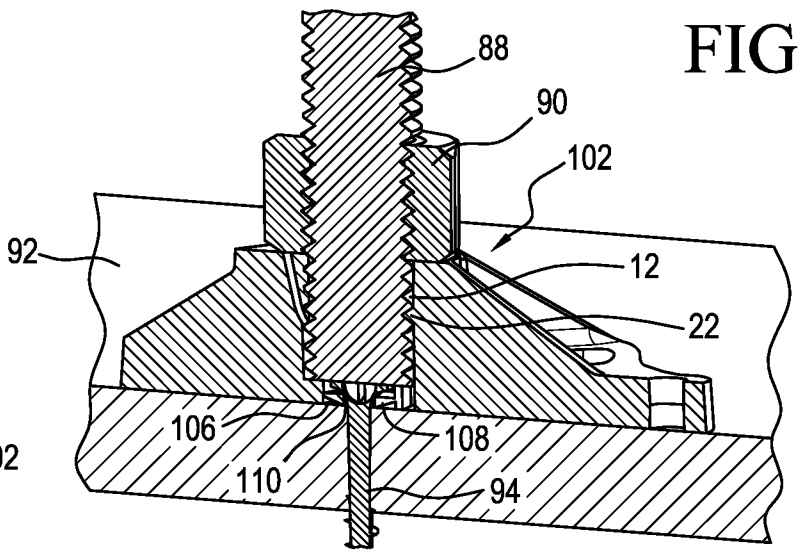
FIG. 15B is a perspective cross-sectional view of FIG. 15A, showing the screw head being supported by a weakened flange.
Figure 15A:
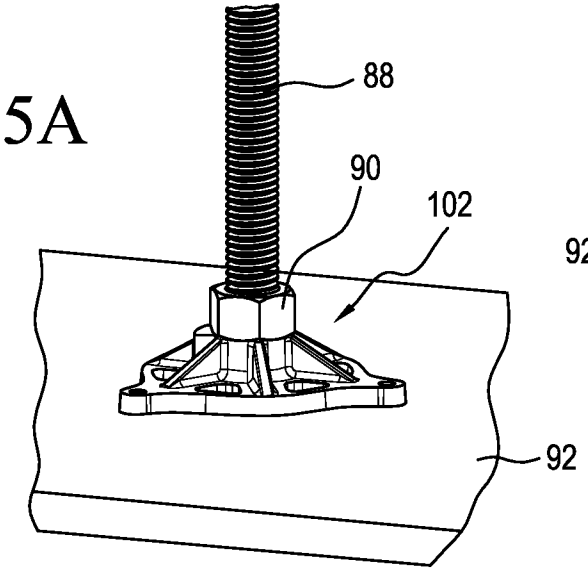
FIG. 15A is a perspective view of another embodiment of a holder similar to the holder of FIG. 2 but without the legs, the holder supporting a threaded rod and a nut used as an anchor body.
Figure 15C:
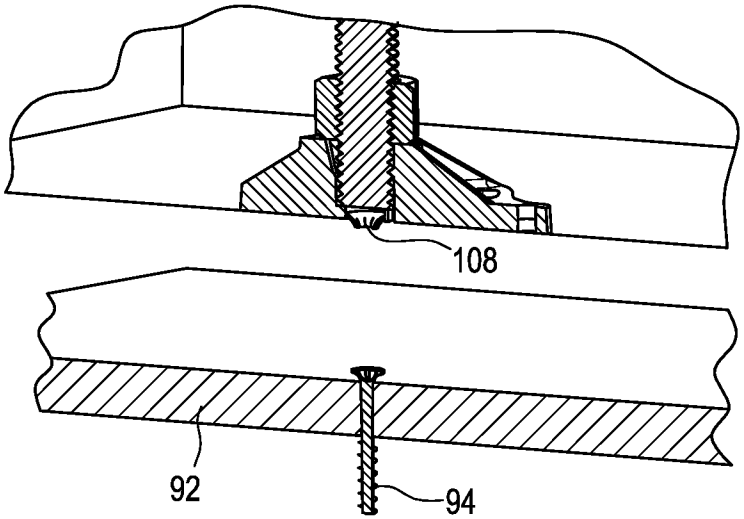
FIG. 15C shows the holder of FIG. 15A embedded in concrete and the form board separated from the concrete with the screw still attached to the form board.

Referring to FIGS. 15A, 15B and 15C, the holder 2 is modified into another embodiment of a holder 102 by removing the leg portions 10 of the holder 2 about along the line 104 in FIG. 6. The holder is attached to the form board 92 through an opening 106 provided with a breakable circumferential flange 108 with an opening 110 through which the shank of the screw 94 passes. The circumferential flange 108 is wedge-shaped in cross-section, thinner at the wall of the opening 106 and thicker at the opening 110. The opening 106 is large enough to allow the head of the screw to pass through after breaking through the circumferential flange 108. The circumferential flange 108 may also be constructed as the flange 31 shown in FIG. 5 or some other ways so as to be readily breakable to allow the head of the screw to break through when the form board 92 is removed after the concrete is cured. As shown in FIG. 15C, the form board 92 is separated from the cured concrete with the screw 94 still attached to the form board after breaking through the circumferential flange 108. The circumferential flange 108 may also be used where a weakened, readily breakable flange is required, such as for the openings 72 and 74 of the holder 48.

Figure 16B:
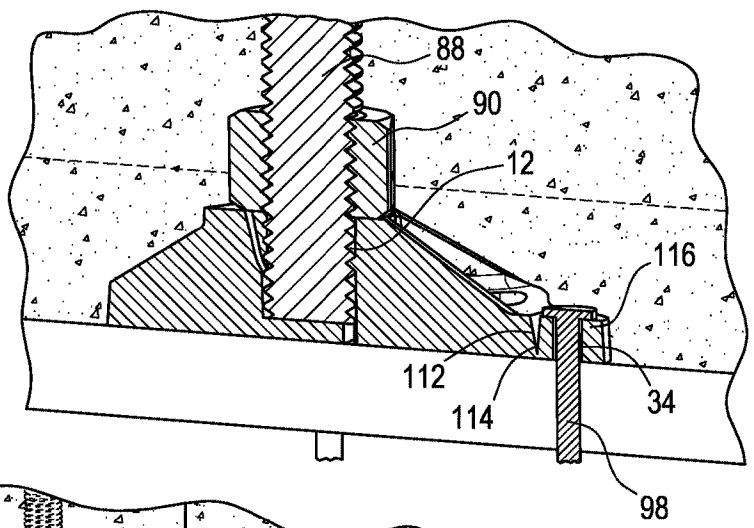
FIG. 16B is a perspective cross-sectional view of FIG. 16A, showing weakened attachment of the wall of the openings.
Figure 16A:
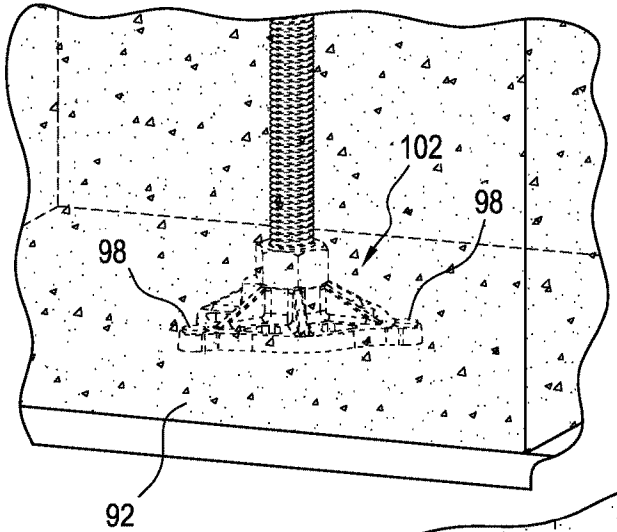
FIG. 16A is the holder of FIG. 15A shown attached to the form board with nails through the outlying openings through the base.
Figure 16C:
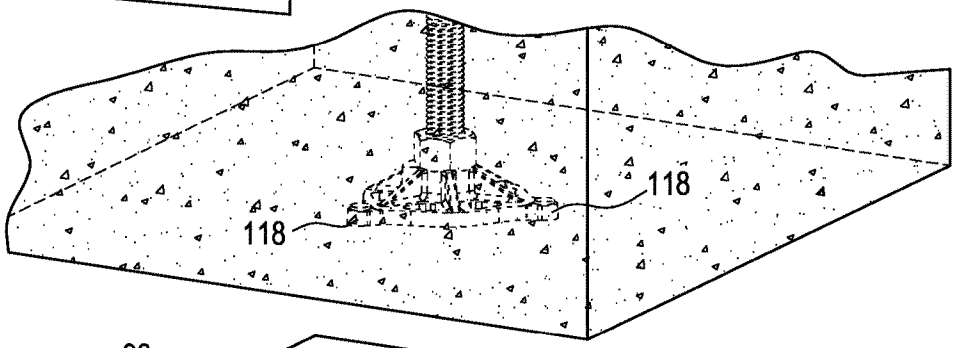
FIG. 16C shows the form board removed from the concrete with the nails still attached to the form board.
Figure 16C:
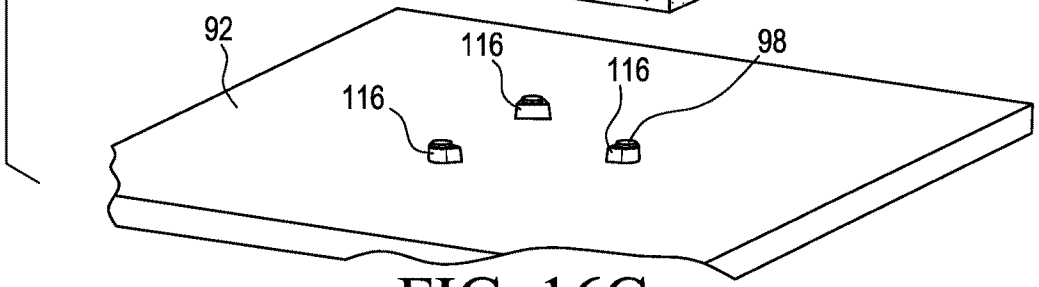

Referring to FIGS. 16A, 16B and 16C, the holder 102 is shown attached to the form board 92 with nails 98 through the holes 34. Attachment of the wall portions of the openings 34 to the main body of the holder 102 is weakened with a slit 114 cut partway through the thickness of the portions 112 so that when the form board 92 is removed after the concrete is cured, the portion around the holes 34 will break off from the rest of the holder and remain on the form board. As shown in FIG. 16C, the wall portions 116 are shown still attached to the nails 98 after separating from the main body of the holder 102. Voids 118 in the concrete made from the portions 116 are shown.

It should be understood that the slit 114 used to weaken the wall portions 116 may also be applied to the foot portions 58 of the holder 48 to make the foot portions 58 breakable from the leg portions 56 as an alternative to using the flange 75 in the openings 76.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A holder for supporting a rod to be embedded in concrete, comprising:

a) a single continuous body of unitary, one-piece construction, the body including a first portion located above a second portion, the first portion and the second portion including a first opening and a second opening, respectively, the first opening being coaxial with the second opening, the first opening being configured to receive an end portion of the rod; and b) a flange disposed at a bottom portion of the second opening, the flange defining a third opening being configured to receive a nail or screw, the third opening being smaller than the second opening.

2. The holder as in claim 1, wherein the first opening is larger in diameter than the second opening.

3. The holder as in claim 1, wherein the first opening is threaded.

4. The holder as in claim 1, wherein the body includes a base portion and leg portions extending downwardly from the base portion.

5. The holder as in claim 1, wherein the body includes a base portion, and the second portion extends below the base portion.

6. The holder as in claim 1, wherein the body includes a base portion, and the first portion extends above the base portion.

7. The holder as in claim 1, wherein the second portion is slotted.

8. The holder as in claim 1, wherein the second portion includes a top edge portion disposed at a bottom portion of the first opening configured to provide a stop to a bottom end of the rod.

9. A holder for supporting a rod to be embedded in concrete, comprising:

a) a unitary body including a first portion located above a second portion, the first portion and the second portion including a first opening and a second opening, respectively, the first opening being coaxial with the second opening, the first opening being configured to receive an end portion of the rod; and b) the second portion including a sidewall with slots defined in the sidewall, the slots opening into the second opening.

10. The holder as in claim 9, wherein the body includes a base portion, and the first portion extends above the base portion.

11. The holder as in claim 9, wherein the body includes a base portion, and the second portion extends below the base portion.

12. The holder as in claim 9, wherein the first opening is larger in diameter than the second opening.

13. The holder as in claim 9, wherein the first opening is threaded.

14. The holder as in claim 9, wherein the second portion includes a top edge portion disposed at a bottom portion of the first opening, the top edge being configured to provide a stop to a bottom end of the rod.

15. A holder for supporting a rod to be embedded in concrete, comprising:

a) a unitary body including a first portion located above a second portion, the first portion and the second portion including a first opening and a second opening, respectively, the first opening being coaxial with the second opening, the first opening being configured to receive an end portion of the rod; and b) the body including a base portion, the first portion extending upwardly from the base portion with the first opening being larger than the second opening, the second portion including a sidewall defining the second opening, the sidewall being attached to the base portion and extending downwardly from the base portion, the second opening being smaller than the first opening.

16. The holder as in claim 15, wherein the first opening is threaded.

* * * * *